US012790098B2

(12) United States Patent
Stocco

(10) Patent No.: US 12,790,098 B2
(45) Date of Patent: Nov. 10, 2026

(54) GLOVE DISPENSING SYSTEM

(71) Applicant: Chealsi Stocco, Green River, WY (US)

(72) Inventor: Chealsi Stocco, Green River, WY (US)

( * ) Notice: Subject to any disclaimer, the term of this patent is extended or adjusted under 35 U.S.C. 154(b) by 159 days.

(21) Appl. No.: 18/645,097

(22) Filed: Apr. 24, 2024

(65) Prior Publication Data

US 2024/0425267 A1 Dec. 26, 2024

Related U.S. Application Data

(60) Provisional application No. 63/589,154, filed on Oct. 10, 2023, provisional application No. 63/509,302, filed on Jun. 21, 2023.

(51) Int. Cl.
*B65D 83/08* (2006.01)

(52) U.S. Cl.
CPC ..... *B65D 83/0805* (2013.01)

(58) Field of Classification Search
CPC ..... B65D 83/0805; A61B 42/40
See application file for complete search history.

(56) References Cited

U.S. PATENT DOCUMENTS 5,683,029 A * 11/1997 Lyons ..... B65D 27/38 229/80
6,026,953 A * 2/2000 Nakamura ..... B65D 75/5838 206/812
6,702,109 B1 * 3/2004 Tabuchi ..... B65D 75/5838 53/133.4
6,820,753 B2 * 11/2004 Kurtz ..... A47K 10/20 211/49.1
8,066,237 B2 * 11/2011 Tyner ..... A61B 50/10 248/905
9,327,892 B2 * 5/2016 Rubo ..... B65D 75/5838
D809,318 S * 2/2018 Hammons ..... B05B 3/14 D6/515
11,059,656 B1 * 7/2021 Rodriguez ..... B65H 18/28
11,723,741 B1 * 8/2023 Benedict ..... A61B 42/40 221/33
2004/0099623 A1 * 5/2004 Kurtz ..... A47K 10/20 248/905
2005/0150785 A1 * 7/2005 Julius ..... B65D 83/0805 206/233
2008/0314920 A1 * 12/2008 Rodrigues ..... A61B 50/20 221/63
2011/0155870 A1 * 6/2011 Tyner ..... A61B 50/10 248/298.1
2014/0061220 A1 * 3/2014 Kowal ..... B65D 83/0805 221/135
2015/0353258 A1 * 12/2015 Yao ..... B65B 51/02 53/485

* cited by examiner

*Primary Examiner* — Michael Collins
(74) *Attorney, Agent, or Firm* — Gurr & Brande, PLLC; Robert A. Gurr

(57) ABSTRACT

A glove dispensing system includes a dispenser, in some examples, made of silicone having a first surface, a second surface opposite the first surface, and a slot. The slot may expand in width to enable a disposable glove to be dispensed therethrough before again closing to prevent further disposable gloves from unintentionally being removed and falling to unsanitary surfaces. In some examples, a dispenser is coupled to a holder configured to receive a glove box, allowing a user to use the dispenser until the glove box is empty, and then replace the glove box with a new box to continue use with the same holder and dispenser.

6 Claims, 16 Drawing Sheets

GLOVE DISPENSING SYSTEM

CROSS-REFERENCE TO RELATED APPLICATIONS

This application claims the benefit of U.S. Provisional Application Ser. No. 63/509,302 filed on Jun. 21, 2023, and further claims the benefit of U.S. Provisional Application Ser. No. 63/589,154 filed on Oct. 10, 2023, both of which are incorporated herein by reference.

TECHNICAL FIELD

The present disclosure relates, in general, to containers and dispensing lids. In particular, the present disclosure relates to a glove dispensing system for the controlled distribution of disposable gloves and other items.

BACKGROUND

An estimated 300 billion disposable gloves are used in the United States each year across various industries. In particular, disposable gloves are often used during medical examinations and procedures to abide by standard precaution practices and help prevent cross contamination between caregivers and patients. Disposable gloves are manufactured from various polymers including latex, nitrile rubber, polyvinyl chloride, and related compounds that create an impermeable barrier. Disposable gloves are further available as either sterile or non-sterile. The proper use of disposable gloves reduces the risk of germ dissemination to the environment and between people, promoting public health.

During use, however, multiple disposable gloves can be unintentionally pulled out of the box and fall to unsanitary surfaces such as the floor, becoming unfit for subsequent use. These circumstances result in millions of wasted disposable gloves each year. While some users install shelves under disposable glove boxes to catch the gloves when they fall out, the shelves can potentially result in contamination similar to the floor. The financial savings and reduced impact on the environment due to conserving otherwise wasted gloves when used at scale in the health industry alone would be substantial.

Accordingly, there is a need for a glove dispensing system that controls the distribution of gloves from their container and prevents waste. The glove dispensing system discussed herein addresses these problems and others.

SUMMARY OF EXAMPLE EMBODIMENTS

In some embodiments, a glove dispensing system comprises a dispenser made of silicone having a first surface and a second surface opposite the first surface. The first surface comprises a slot and a ridge. The slot, without limitation, may expand in width between 0.063 inches and 0.25 inches to enable a disposable glove to be dispensed therethrough before again closing to prevent further disposable gloves from unintentionally being removed and falling to unsanitary surfaces. The slot further comprises circular apertures on each side of the slot configured to support and prevent tearing of the slot.

In some embodiments, a glove dispensing system comprises a housing having a dispenser made of silicone with a slit on a first surface. The housing further comprises an aperture configured to receive a glove box. Once the glove box is empty, the glove box may be removed via the aperture and another glove box inserted therein, promoting reusability.

In some embodiments, a glove dispensing system comprises a holder and a dispenser couplable to the holder. The holder comprises a first side with an aperture and one or more lips or railings along the edges of the first side configured to be couplable to the glove box. The holder may further comprise a second side and a third side forming a partial container or housing to receive and hold the glove box. The dispenser may be coupled to the holder substantially around the aperture on the first side such that gloves or other items may be dispensed therethrough. The holder may comprise a tab on the first side that extends partially over the aperture and further assists in the separation of one glove from another during removal for use.

DETAILED DESCRIPTION OF EXAMPLE EMBODIMENTS

Figure 1:
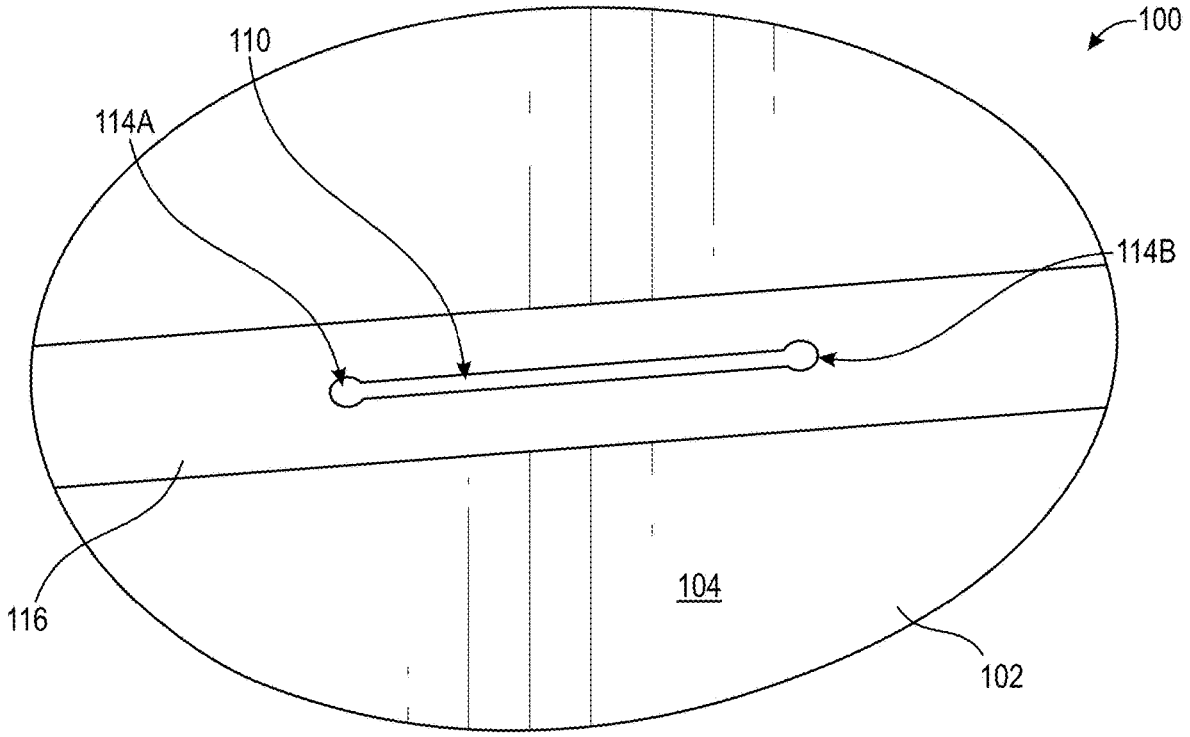
FIG. 1 shows a top plan view of a glove dispensing system.
Figure 2:
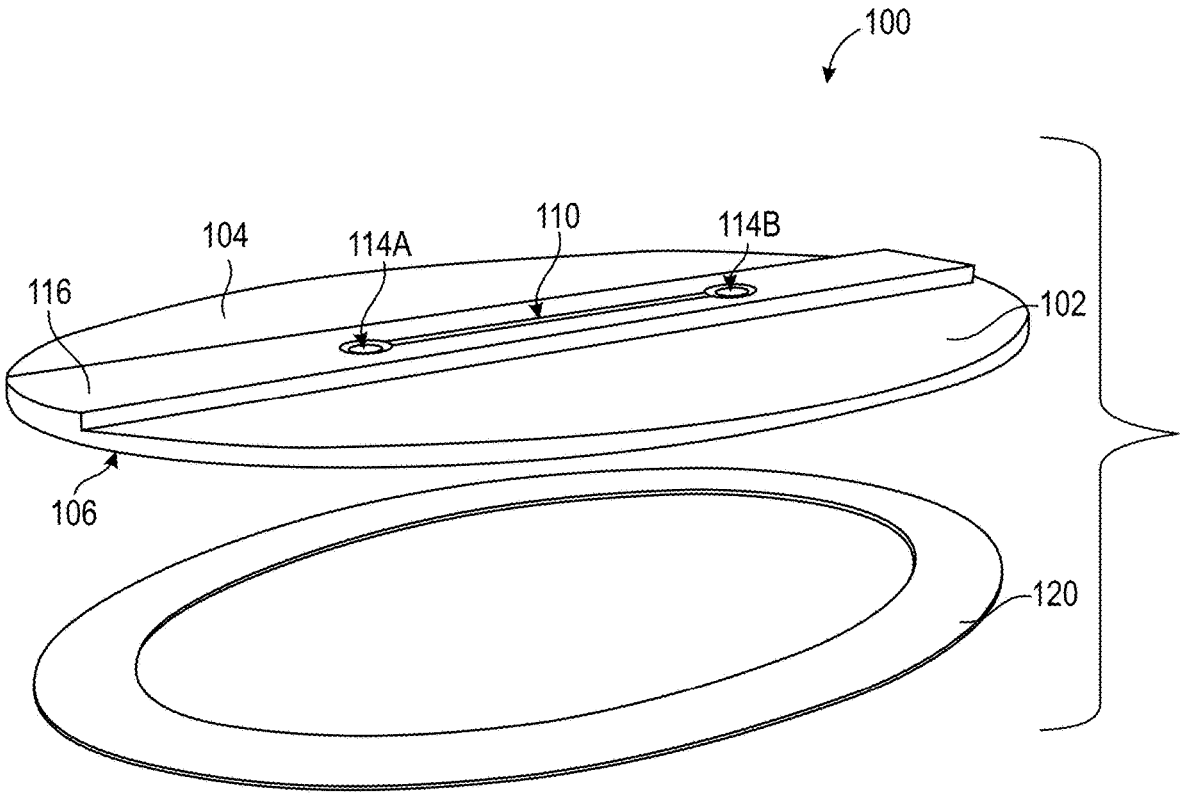
FIG. 2 illustrates a top, side perspective view of a dispenser and a release liner.
Figure 3:
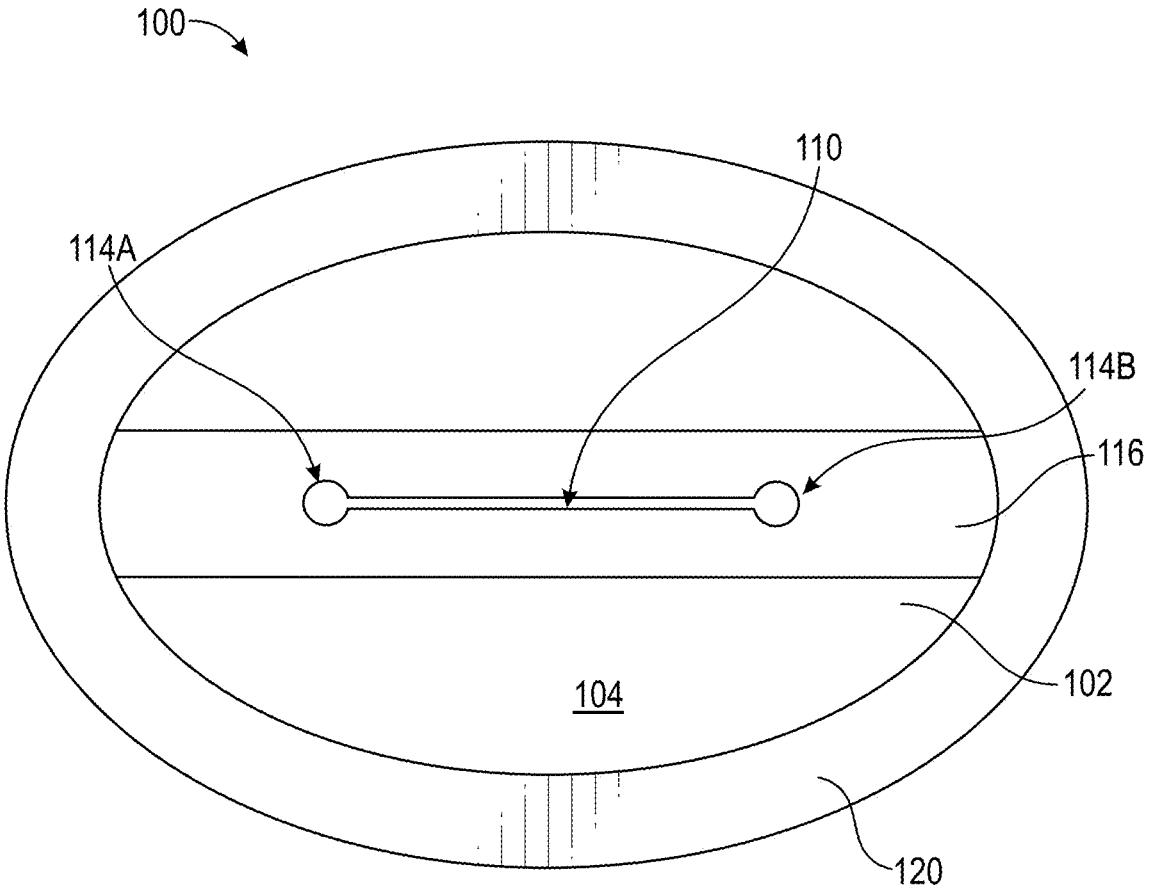
FIG. 3 illustrates bottom plan view of a glove dispensing system
Figure 4:
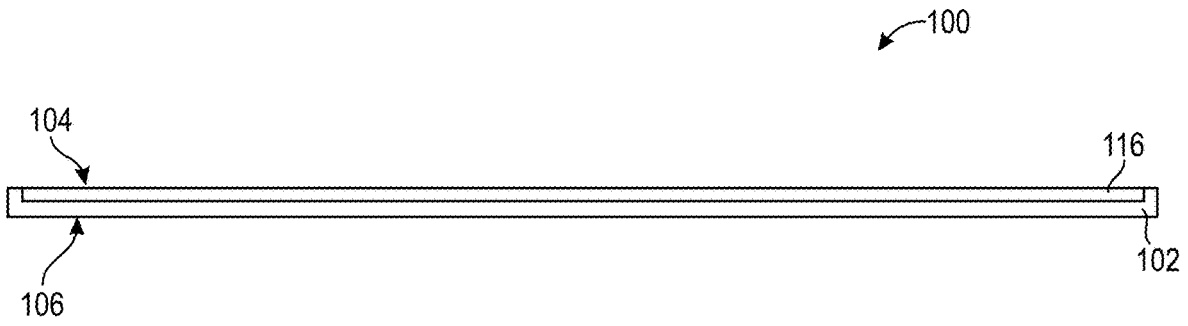
FIG. 4 illustrates a side elevation view of a glove dispensing system.
Figure 5:
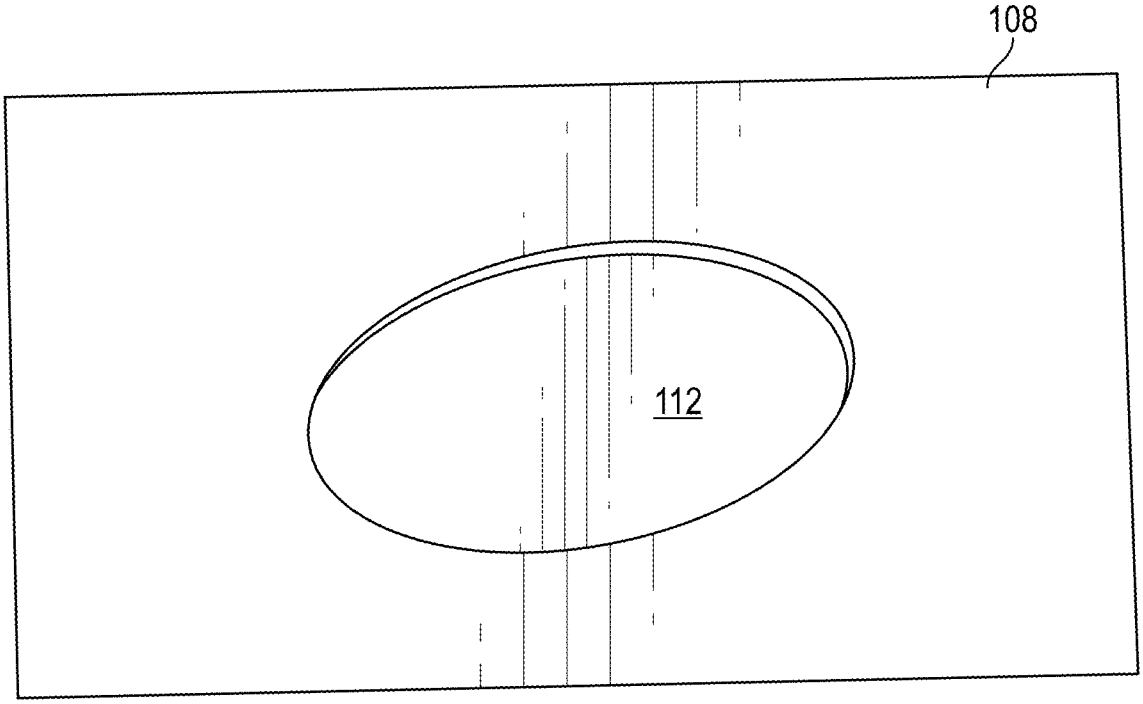
FIG. 5 shows a top plan view of a glove box without a dispenser.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a glove dispensing system that controls the distribution of disposable gloves from their container and prevents waste. The glove dispensing system discussed herein addresses these problems and others.

As shown in FIGS. 1-8, in some embodiments, a glove dispensing system 100 comprises a dispenser 102 having a first surface 104 and a second surface 106 opposite the first surface 104. The dispenser 102 may be manufactured from silicone or related flexible polymers. In some embodiments, though without limitation, the silicone may be rated 40 on the Shore A hardness scale, having a medium hardness while maintaining a somewhat flexible quality. As depicted, though without limitation, the dispenser 102 may be substantially oval or round in shape, corresponding to a standard opening of a glove box 108.

The first surface 104, in some embodiments, comprises a slit 110 or other aperture configured to control distribution of one or more disposable gloves 112 (FIG. 8) from a glove box 108. The slit 110 may comprise, without limitation, a length that is 2.75 inches long and a width that is 0.063 inches wide. In some embodiments, the slit 110 may comprise circular apertures 114A-B at each end of the slit 110, wherein the circular apertures 114A-B support expansion of the slit 110, without limitation, between 0.063 inches and 0.25 inches, preventing tearing from occurring along the slit 110. After removal of a single disposable glove 112, the width of the slit 110 contracts, without limitation, from 0.25 inches to 0.063 inches, to prevent unintentional removal of further disposable gloves 112. It will be understood, however, that the length and the width of the slit 110 may be more or less than the measurements described above without departing from the teachings herein.

The first surface 104 may further comprise a ridge 116 along a longitudinal axis of the dispenser 102 that supports the resilience of the slit 110 thereon. The ridge 116 comprises thicker material (e.g., silicone) that also reinforces the overall structural design of the dispenser 102 and to further prevent tearing of the slit 110 as a user pulls gloves 112 therethrough.

Figure 6:
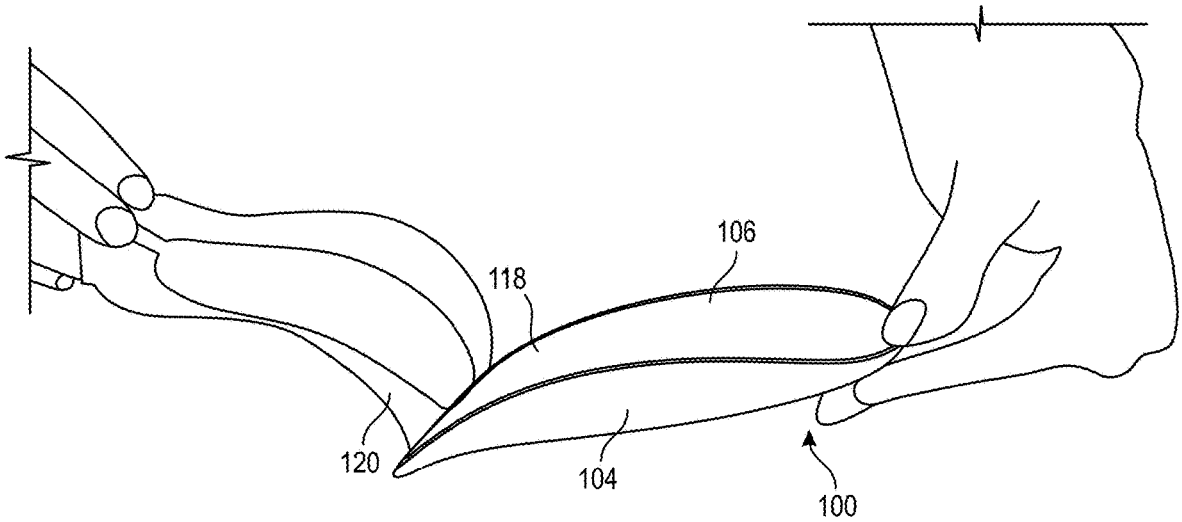
FIG. 6 shows a bottom, side perspective view of a release liner being removed from a dispenser.

The second surface 106, in some embodiments, may be flat. As best seen in FIG. 6, the glove dispensing system 100 further comprises an adhesive layer 118 that is coextensive with at least part of the second surface 106 and a release liner 120 removably couplable to the adhesive layer 118. The adhesive layer 118, as depicted, may be located around the perimeter of the second surface 106 without covering the opening of the glove box 108. After removal of the release liner 120, the adhesive layer 118 allows a user to press and stick the dispenser 102 to the glove box 108, as shown in FIG. 7.

The adhesive layer 118 may be configured to either permanently or removably adhere to the glove box 108. In some embodiments, intended for temporary, detachable adherence to the glove box 108, the adhesive layer 118 may comprise sticky tack or related pressure-sensitive adhesive materials known in the art. It will be appreciated that said embodiments enable a user to detach the adhesive layer 118 and reuse the glove dispensing system 100 with subsequent glove boxes 108 after the first glove box 108 is empty. In some embodiments, intended for single-use adherence, the adhesive layer 118 may comprise double sided tape or more permanent adhesives.

Figure 7:
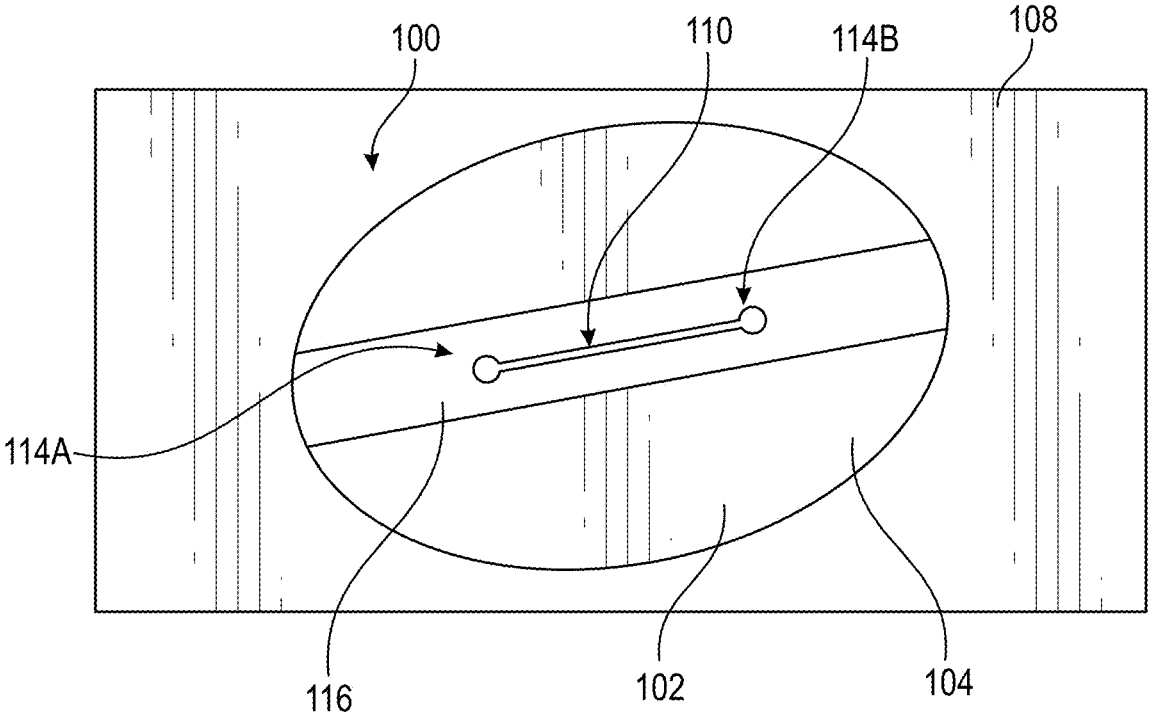
FIG. 7 shows a top plan view of a glove dispensing system coupled to a glove box.
Figure 8:
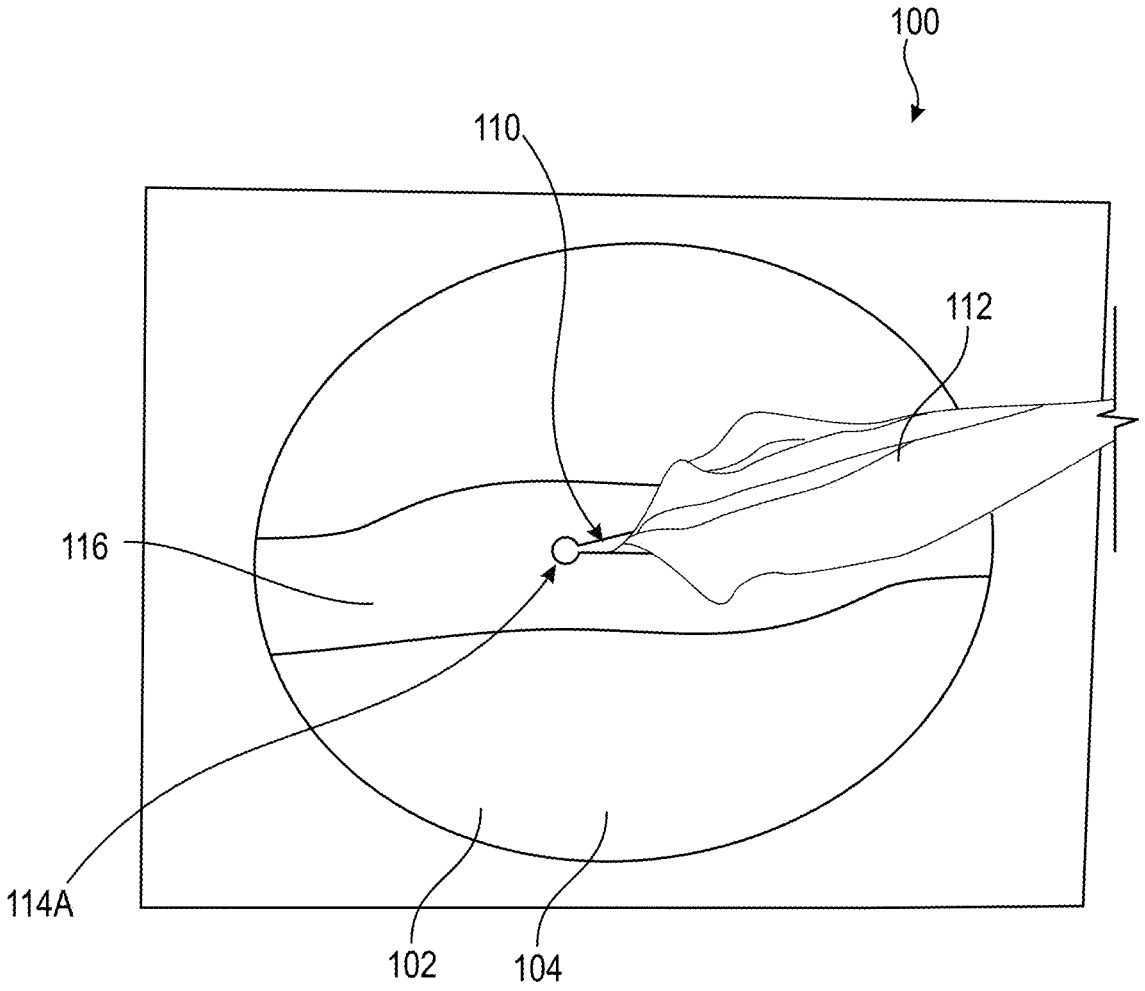
FIG. 8 shows a disposable glove being removed by a user from the glove dispensing system.

As shown in FIGS. 6-8, in some embodiments, a method of using a glove dispensing system 100 comprises removing a release liner 120 from an adhesive layer 118 on a second surface 106 of a dispenser 102, pressing the adhesive layer 118 around an opening of a glove box 108, and, as shown in FIG. 8, removing a disposable glove 112 through a slit 110 in the dispenser 102, wherein a width of the slit 110 expands to accommodate removal of the disposable glove and thereafter contracts to initial conditions to prevent further disposable gloves 112 from unintentionally falling out of the opening of the glove box 108.

Figure 9:
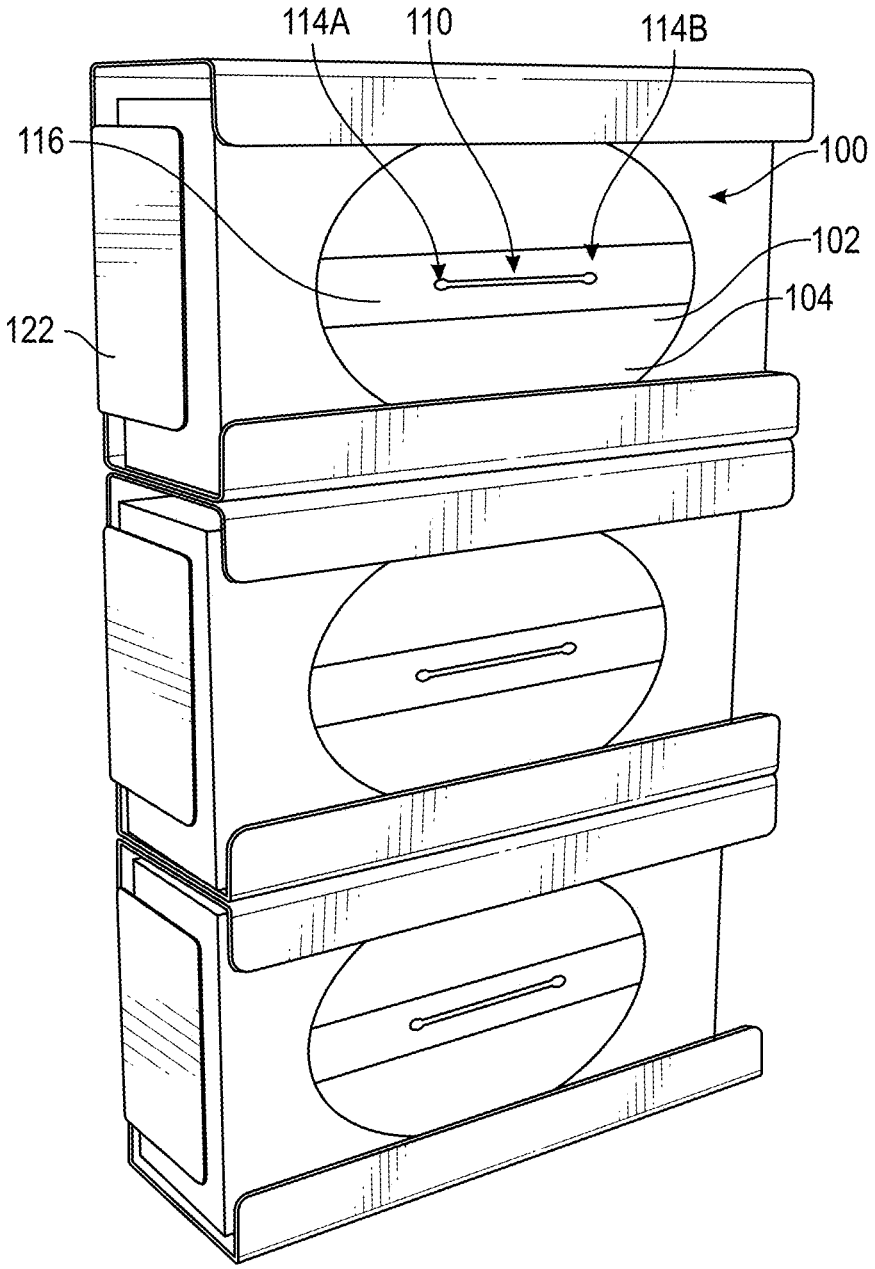
FIG. 9 illustrates a glove dispensing system coupled to glove box within a wall mount.

As illustrated in FIG. 9, the glove dispensing system 100 is compatible with wall-mounted glove box holders 122 and related glove box containers. Furthermore, multiple glove dispensing systems 100 may be mounted together to permit various sizes, varieties, and quantities of disposable gloves 112 to be housed together. While the glove dispensing system 100 describes usage with disposable gloves 112, it will be appreciated that the glove dispensing system 100 may be used to dispense related goods such as medical accessories, utensils, toiletries, and other items.

Figure 10:
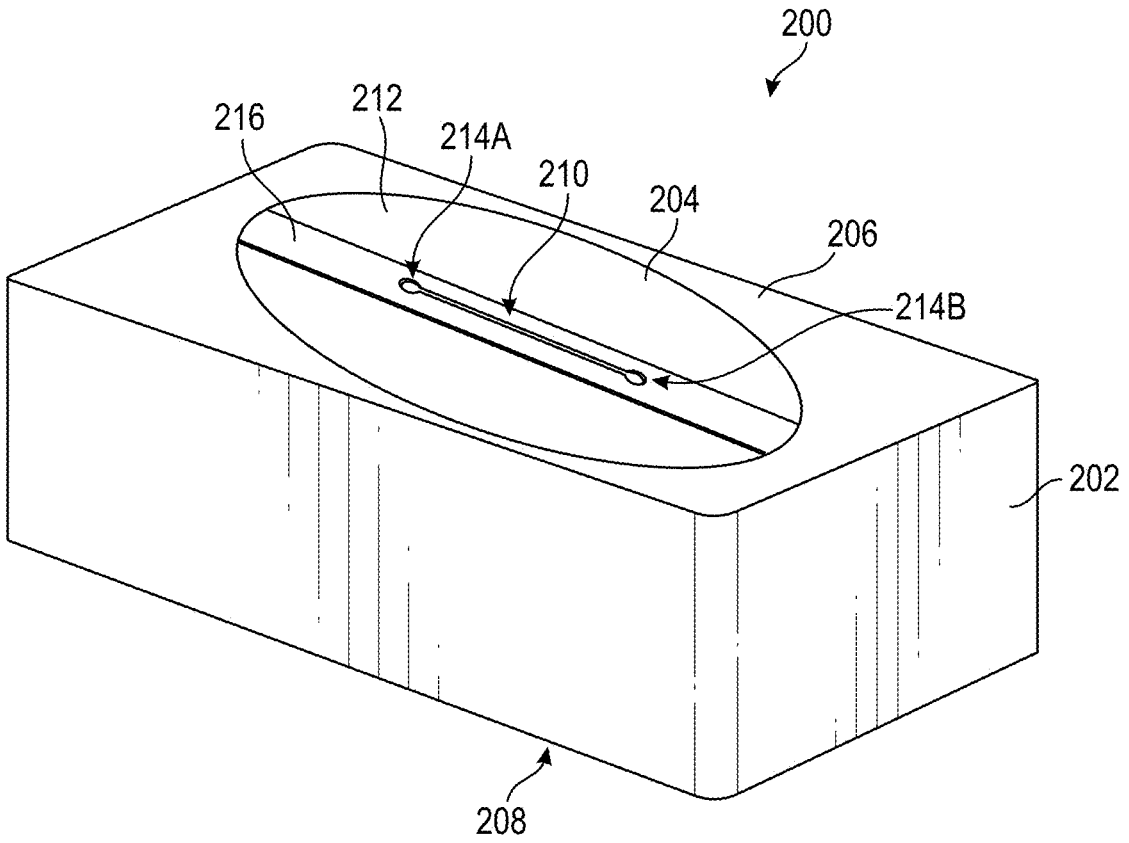
FIG. 10 shows a top, side perspective view of a glove dispensing system according to some embodiments.
Figure 11:
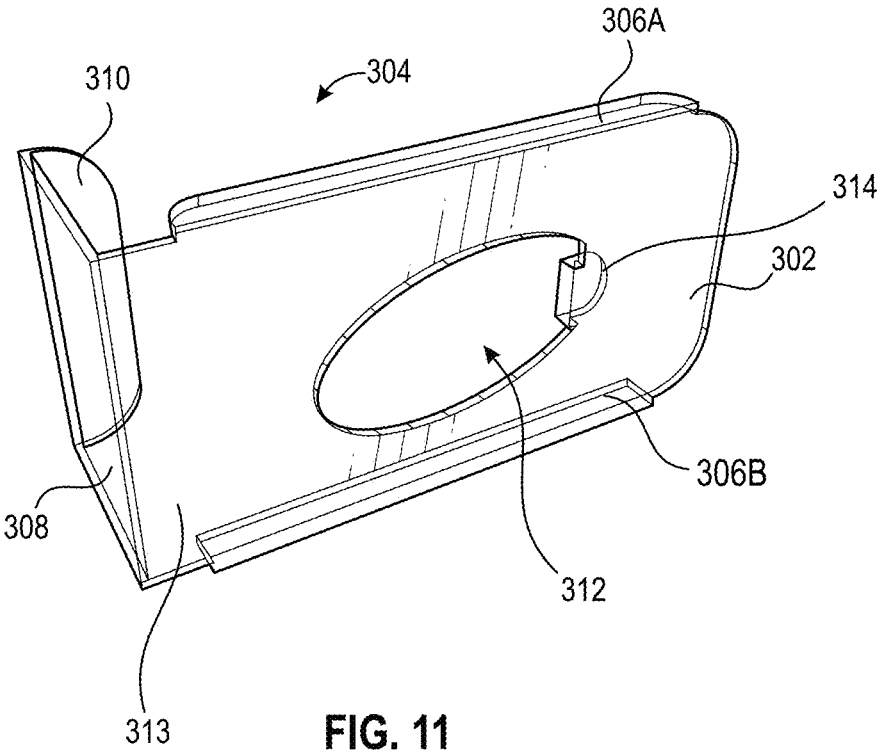
FIG. 11 shows a perspective view of a box holder of a glove dispensing system without a dispenser coupled thereto.
Figure 12:
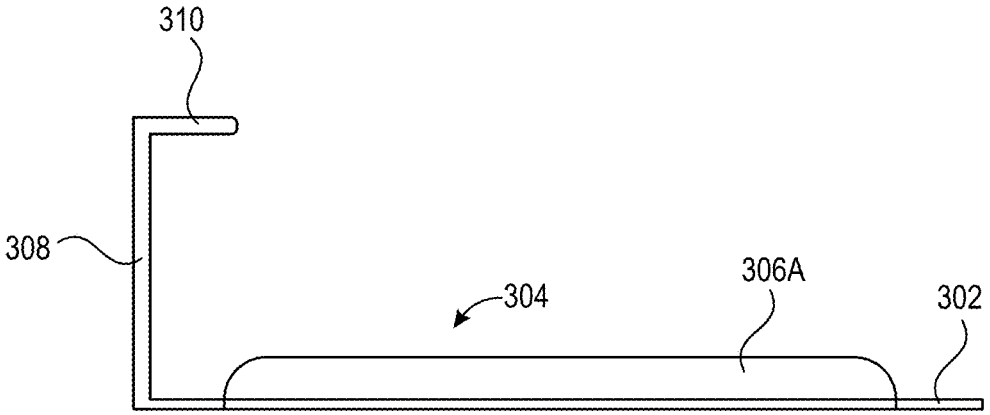
FIG. 12 shows a top plan view of a box holder of a glove dispensing system without a glove box therein.
Figure 13:
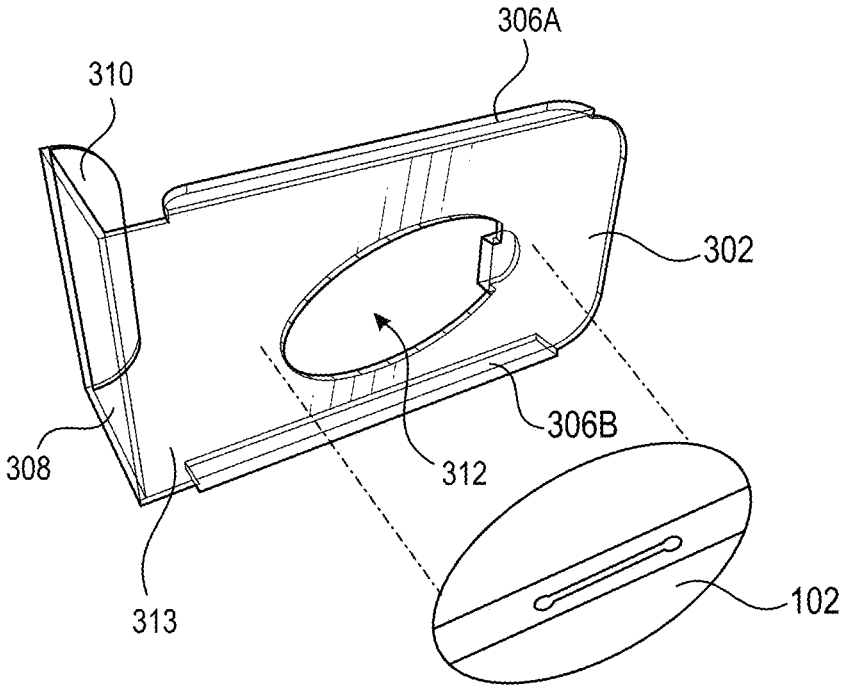
FIG. 13 shows a front, left perspective view of a box holder of a glove dispensing system receiving a dispenser thereon.
Figure 14:
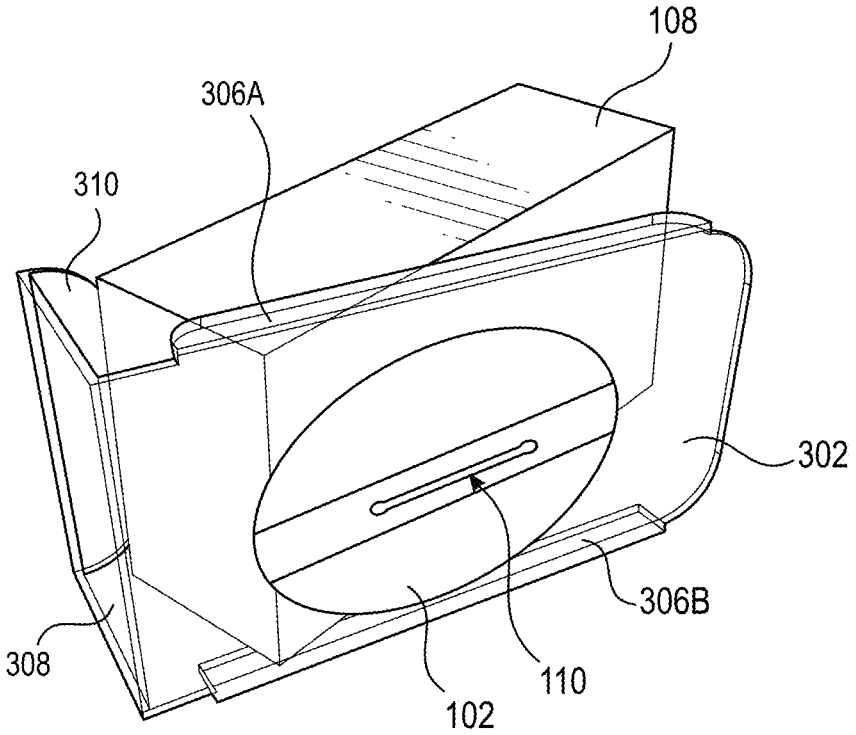
FIG. 14 a shows a front, left perspective view of a glove box being inserted into a box holder of a glove dispensing system.
Figure 15:
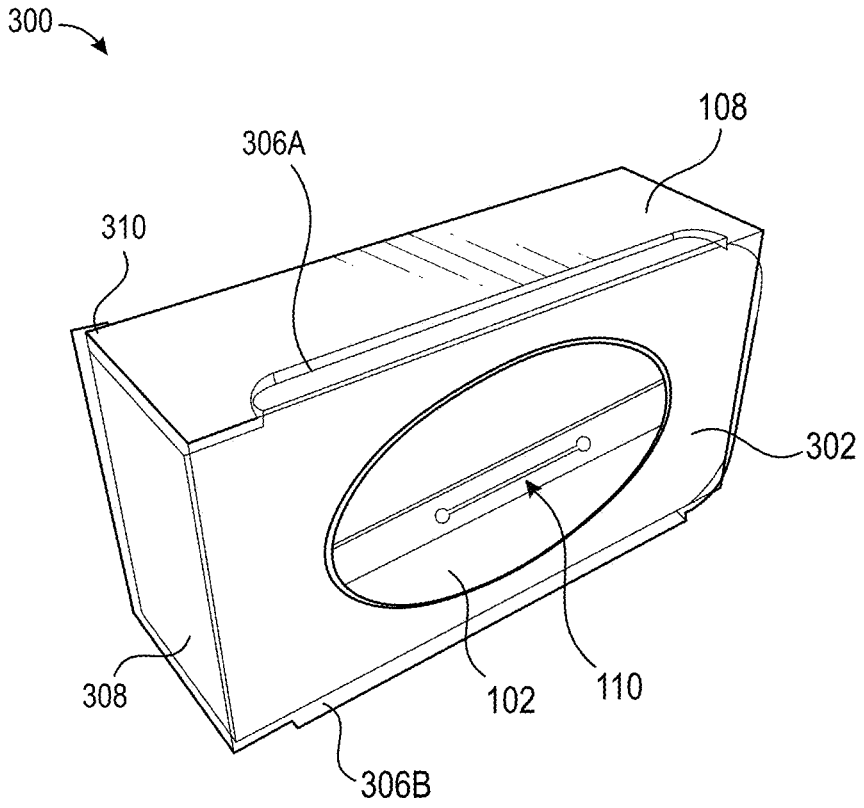
FIG. 15 shows a front, left perspective view of a glove dispensing system.

As shown in FIG. 10, in some embodiments, a glove dispensing system 200 comprises a housing 202 having a dispenser 204 on a first surface 206 of the housing 202, and an aperture 208 configured to receive a glove box. For example, the housing 202 may be five-sided, allowing a glove box to be received into the housing through the open sixth side. The housing 202 may comprise plastics or other materials that withstand repeated use and that may be cleaned or sanitized. The dispenser 204 comprises a slit 210 configured to control distribution of one or more disposable gloves 112 from a glove box 108. For example, the first surface 212 of the dispenser 204 may comprise a slit 210 having, without limitation, a length that is 2.75 inches long and a width that is 0.063 inches wide. In some embodiments, the slit 210 may comprise circular apertures 214A-B at each end of the slit 210, wherein the circular apertures 214A-B support expansion of the slit 210, without limitation, between 0.063 inches and 0.25 inches preventing tearing from occurring along the slit 210.

After removal of a single disposable glove 112, the width of the slit 210 contracts, without limitation, from 0.25 inches to 0.063 inches to prevent unintentional removal of further disposable gloves 112. It will be understood, however, that the length and the width of the slit 210, along with the variation when gloves 112 are pulled therethrough, may be more or less than the distances described above without departing from the teachings herein.

The dispenser 204 may further comprise a ridge 216 along a longitudinal axis of the dispenser 204 that supports the resilience of the slit 210 thereon. The dispenser 204 may be manufactured from silicon or related flexible polymers as described earlier. The dispenser 204 may be integrated with the housing 202 or permanently adhered to the housing 202. In examples of use, a user may insert the glove box 108 into the aperture 208 of the housing 202. Then, when the glove box 108 becomes empty, a user may remove the empty glove box 108 and insert a new glove box 108 in its place. Thus, the glove dispensing system 200 is reusable without the need to remove the dispenser 204 from the housing 202.

As illustrated in FIGS. 11-15, a glove dispensing system 300, in some embodiments, comprises a holder 302 and a dispenser 102 couplable to the holder 302. The holder 302 comprises a rear side 304 with one or more lips or railings 306A-B along the edges of the rear side 304 configured to be couplable to, or otherwise support, the glove box 108. The holder 302 may further comprise a second side 308 and a third side 310 to at least partially surround the glove box 108, forming a partial container or housing to receive and hold the glove box 108. The dispenser 102 may be coupled to the holder 302 substantially around an aperture 312 on a front face 313 such that gloves or other items may be dispensed through both the aperture 312 of the holder 302 and the slit 110 of dispenser 102.

The holder 302 may comprise a tab 314 on the rear side 304 that is configured to insert into the opening of a glove box 108 and at least partially under the surface of the glove box 108 so as to aid in retaining the glove box 108 in position as users push through the dispenser 102, grab a glove 112 in the glove box 108, and withdraw the glove through the slit 110 of the dispenser 102. As needed, a new glove box may be substituted for an empty glove box while maintaining the same holder 302 and dispenser 102. In some embodiments, the dispenser 102 may be integrated with the holder 302. It will be appreciated that the holder 302 may be manufactured from a variety of materials, including plastics, metals, woods, carbon fibers, etc.

Figure 16:
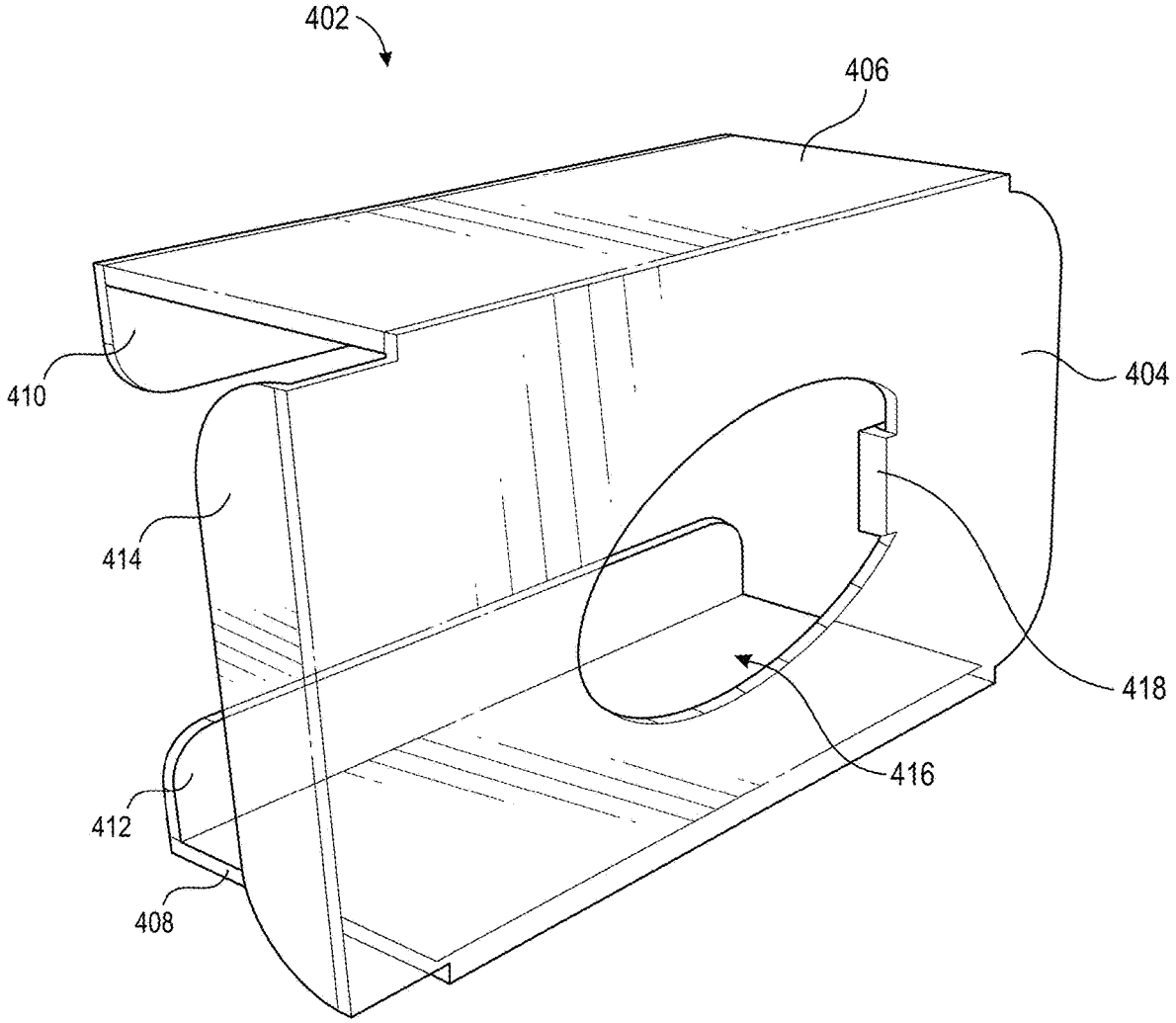
FIG. 16 shows a front, left perspective view of a glove dispensing system.
Figure 17:
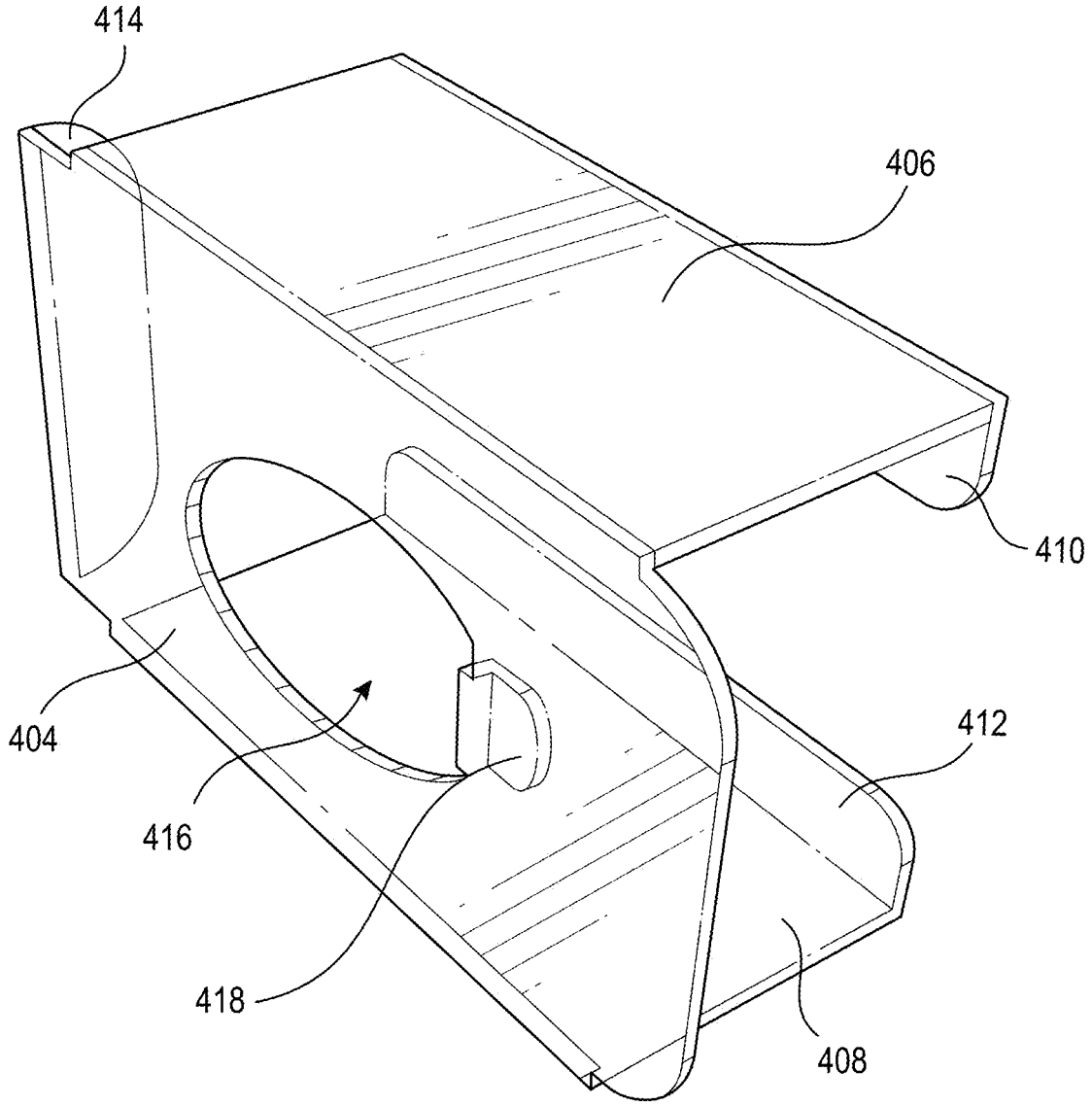
FIG. 17 shows a front, right perspective view of a glove dispensing system.
Figure 18:
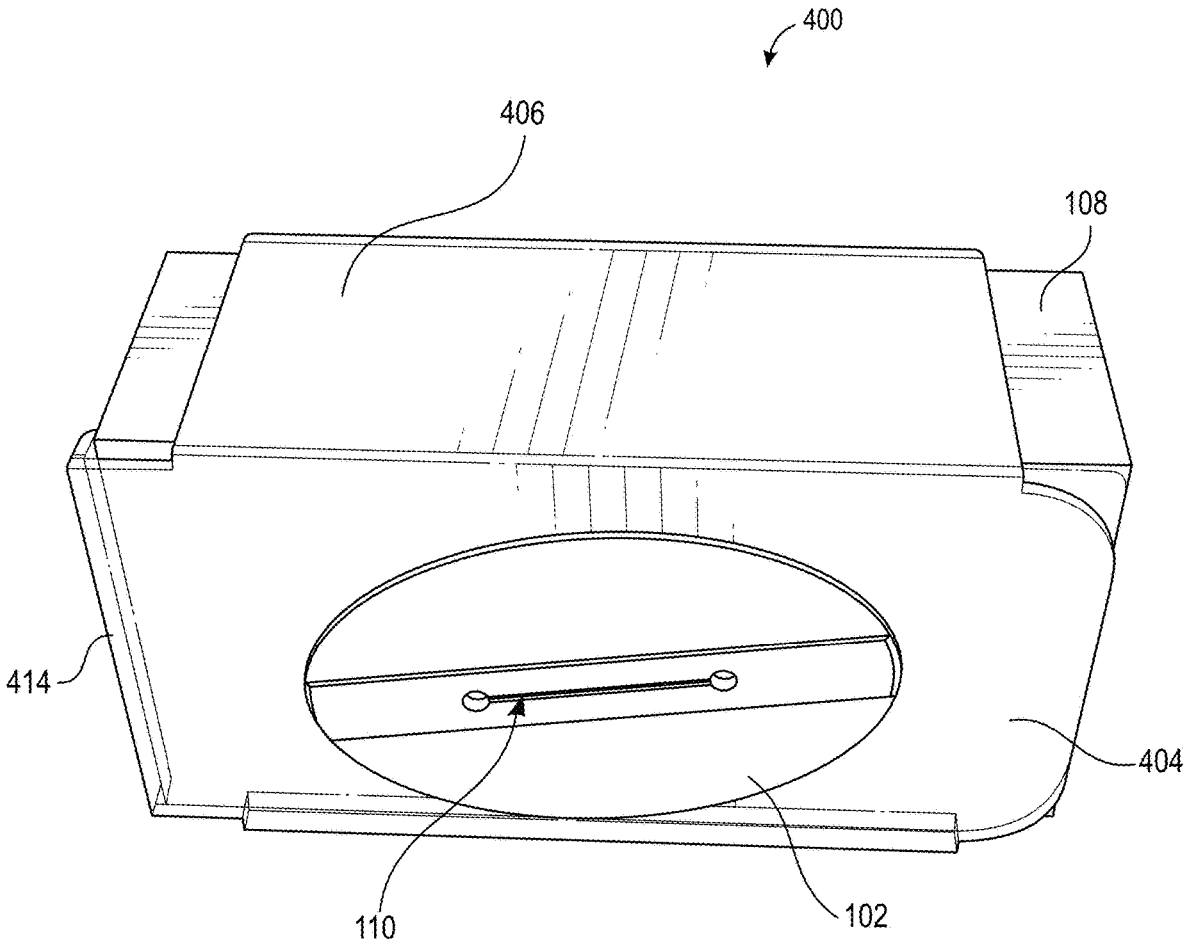
FIG. 18 shows a front, top perspective view of a glove dispensing system.

As illustrated in FIGS. 16-18, a glove dispensing system 400, in some embodiments, comprises a holder 402 and a dispenser 102 couplable to the holder 402. The holder 402 comprises a front face 404, a top member 406, a bottom member 408, a top lip 410, a bottom lip 412, and a side lip 414, which are configured to form a partial container or housing to receive and hold the glove box 108, as shown in FIG. 18. The dispenser 102 may be coupled to the holder 402 (either permanently or by using removably attachable adhesives or other methods) substantially around an aperture 416 such that gloves or other items may be dispensed through both the aperture 416 of the holder 402 and the slit 110 of dispenser 102. In this example, the glove box 108 is insertable behind the front face 404, between the top member 406 and bottom member 408 until the glove box 108 abuts the side lip 414. The top lip 410 and the bottom lip 412 prevent the glove box 108 from inadvertent withdrawal and may also provide a surface to attach the holder 402 to a wall or other surface, such as by using adhesives or other mechanisms or methods of affixing.

The holder 402 may comprise a tab 418 adjacent to the aperture 416 and extending rearwardly for a first length and then parallel to the front surface 404 for a second length. The tab 418 is configured to insert into the opening of a glove box 108 and at least partially under the surface of the front of the glove box 108 so as to aid in retaining the glove box 108 in position as user's push through the slit 110 of dispenser 102, grab a glove 112 in the glove box 108, and withdraw the glove 112 through the slit 110 of the dispenser 102. As needed, a new glove box 108 may be substituted for an empty glove box 108 while maintaining the same holder 402 and dispenser 102. In some embodiments, the dispenser 102 may be integrated with the holder 402. It will be appreciated that the holder 402 may be manufactured from a variety of materials, including plastics, metals, woods, carbon fibers, etc.

In some embodiments, a glove box 108 may be manufactured with the glove dispensing system 100 integral thereto, which would then be discarded with the glove box 108 once emptied. While reusable versions are preferred, it will be appreciated that all uses are contemplated herein, including multiple use, single use, and integration, among others. Further, while silicone and various measurements were described herein, the present disclosure is not so limited and other materials and sizes that achieve the same end result are contemplated herein.

The present disclosure addresses the need for a glove dispensing system that controls the distribution of disposable gloves from their container and prevents waste. Accordingly, the glove dispensing system 100, 200, 300, and 400 described herein solves these problems and others.

It will be appreciated that systems and methods according to certain embodiments of the present disclosure may include, incorporate, or otherwise comprise properties or features (e.g., components, members, elements, parts, and/or portions) described in other embodiments.

Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A glove dispensing system, comprising:

a holder, comprising:

a front face comprising an aperture;

a top member and a bottom member both extending rearwardly from the front face and configured to receive a glove box therebetween;

a side lip configured to limit lateral movement of the glove box relative to the holder;

a top lip extending downwardly from the top member and configured to retain the glove box behind the front face;

a bottom lip extending upwardly from the bottom member and configured to retain the glove box behind the front face;

a tab adjacent to the aperture of the front face, the tab extending rearwardly from the front face for a first length and then extending generally parallel to the front face for a second length, the tab configured to insert into an opening of the glove box and at least partially under a front surface of the glove box; and a dispenser coupled to the holder around the aperture and configured to overlap the aperture on the front face, the dispenser comprising a slit extending longitudinally along at least a portion of a body of the dispenser.

2. The glove dispensing system of claim 1, wherein the dispenser is adhered to the holder.

3. The glove dispensing system of claim 1, wherein the slit of the dispenser further comprises circular apertures at each end.

4. The glove dispensing system of claim 1, wherein the dispenser further comprises a ridge extending longitudinally along the body of the dispenser, the slit positioned along the center of the ridge.

5. The glove dispensing system of claim 1, wherein the dispenser is removably adhered to the holder.

6. A glove dispensing system, comprising:

a five-sided holder defining an interior configured to receive a glove box and having one open side through which the glove box is receivable, the five-sided holder comprising:

a front face comprising an aperture;

a tab adjacent to the aperture of the front face, the tab extending rearwardly from the front face for a first length and then extending generally parallel to the front face for a second length, the tab configured to insert into an opening of the glove box and at least partially under a front surface of the glove box; and a dispenser coupled to the five-sided holder around the aperture and configured to overlap the aperture on the front face, the dispenser comprising a slit extending longitudinally along at least a portion of a body of the dispenser.

* * * * *